US005699638A

United States Patent [19]

Maylon

[11] Patent Number: 5,699,638

[45] Date of Patent: Dec. 23, 1997

[54] STUCCO ARCH CASING BEAD

[75] Inventor: Gary Joseph Maylon, Trussville, Ala.

[73] Assignee: Alabama Metal Industires Corporation, Birmingham, Ala.

[21] Appl. No.: 703,013

[22] Filed: Aug. 26, 1996

[51] Int. Cl.[6] ..... E04B 1/00

[52] U.S. Cl. ..... 52/86; 52/255; 52/288.1; 52/417

[58] Field of Search ..... 52/85, 86, 88, 52/211, 212, 204.53, 204.54, 254, 255, 288.1, 417; 428/61, 156, 174, 188

[56] References Cited

U.S. PATENT DOCUMENTS

| | | | |
|---|---|---|---|
| 1,988,739 | 1/1935 | Jones . | |
| 2,274,662 | 3/1942 | Briggs et al. . | |
| 2,311,345 | 2/1943 | Mitchell | 52/85 X |
| 3,008,273 | 11/1961 | Widin . | |
| 4,863,774 | 9/1989 | Tucker . | |
| 5,048,247 | 9/1991 | Weldy . | |
| B1 5,048,247 | 2/1994 | Weldy . | |

FOREIGN PATENT DOCUMENTS 2056523 6/1980 United Kingdom .

OTHER PUBLICATIONS

Pla-Cor™ Plastic Corner Bead System, 4 pages, copyright 1992.

Vinyl Corp. Product Data, 4 pages, 1990.

Trim-Tex Inc.® Product Catalog, Apr. 1993, 5 pages.

*Primary Examiner*—Lanna Mai

*Attorney, Agent, or Firm*—Trexler, Bushnell, Giangiorgi & Blackstone, Ltd.

[57] ABSTRACT

An arch casing bead having a mounting flange and a ground flange extending therefrom. The mounting flange includes a free edge and an edge proximate to a junction of the ground flange and the mounting flange. A notch is formed in the mounting flange extending from the free edge towards the ground flange. The notch defines an arcuate portion which is positioned proximate to the ground flange. A pair of spaced apart edges extend from the arcuate portion to the free edge defining a mouth of the notch. The notch facilitates arcuate deformation of the elongated casing bead without angularly deforming the ground flange.

19 Claims, 3 Drawing Sheets

STUCCO ARCH CASING BEAD

BACKGROUND

The present invention relates to plastering and stucco building accessories and more particularly to a casing bead article for use in forming arches in stucco or plaster constructions.

As noted, the present invention relates to casing bead. This is to be distinguished from a corner bead article. Casing bead is used in a stucco or plaster construction to provide a terminus or cap on the end of the plaster surface. For example, a casing bead may be used where a plaster wall meets a window frame. In this application, the casing bead is attached in close proximity to the window frame and plaster is applied directly up to the edge of the casing bead. The casing bead includes a mounting flange, a ground flange which extends from the mounting flange, and in some applications a return extending from the top edge of the ground flange. An external surface of the ground flange provides a final finished face which is not plastered and is ready for finish painting at the end of the plastering operation.

In contrast, a corner bead is used at the angular intersection of two plaster surfaces. The corner bead includes two mounting flanges which intersect at a nose. The mounting flanges are attached to respective plaster areas with plaster being applied over each flange. Plaster is worked on each side of the corner bead and up to the nose.

In arch constructions, it is important to provide a smooth arcuate resulting surface for aesthetic and architectural purposes. As such, it is undesirable to have corner or casing bead which kinks or forms angular bends. If corner or casing bead kinks it requires much time in correcting and reworking in order to achieve the smooth arcuate surface.

Corner bead material is often used for arch constructions since it includes two mounting flanges. A cut is made through the mounting flanges generally perpendicular to the nose to allow the corner bead to be flexed relative to the nose. The goal of the cutting and flexing is to have the nose achieve a smooth arcuate edge. Cuts can be placed closer or further apart along the mounting flanges depending on the desired radius of the finished arch. Corner bead is used in many situations because it offers two plaster surfaces. Both surfaces may be worked to achieve the desired results. However, working both surfaces is time consuming and difficult in casing constructions.

While casing bead typically provides desired arch results, it is more difficult to form an arch, especially having a smaller radius, than using corner bead. The problem that arises with forming an arch construction with casing bead material is that only the mounting flange is cut. The ground flange cannot be cut as it forms a finished surface of the case arch. As such, prior art techniques used in forming arch construction using corner bead may not be appropriate for use in forming arch constructions using casing bead material. Casing bead may be more desirable to use, especially when a small finished casing edge is desired because the casing surface does not need to be plastered, worked or finished.

It has been difficult to work with casing bead material to form arches. Tradespersons cut the mounting flange of casing bead material in order to form arch constructions. While this is the typical technique, it is often carried out in the field. In the field, at the installation site, it is time consuming and inefficient to cut the mounting flange. Further, cutting the mounting flange in the field also produces inaccuracies in the position of the notches formed by cutting which can result in irregularities in the finished arch construction. These irregularities result in additional time and effort to correct these anomalies. Additionally, since casing bead material is often cut in the field, such cutting may be inaccurate resulting in cuts which compromise the integrity of the ground flange further promoting kinking, crimping or angular deformation of the ground flange.

The problems described hereinabove are exacerbated by the use of plastic or vinyl materials in forming plaster wall construction accessories. While metal casing bead may be somewhat more forgiving, it nevertheless may crimp or angularly deform when the mounting flange is cut. The use of plastic materials in such accessories, however, exacerbates the problem because plastic is less forgiving and may tend to propagate cracks more easily when the material is flexed or bent. As a result of the cracks propagating more easily in plastic, more irregularities occur and more waste is encountered with such plastic plaster construction accessories.

For the foregoing reasons, it would be highly desirable to provide an arch casing bead which reduces or prevents crimping.

OBJECTS AND SUMMARY

A general object satisfied by the claimed invention is to provide an arch casing bead which includes a plurality of notches to permit an elongated section of the arch casing bead to be formed in an arc for defining an arched casing edge.

Another object satisfied by the claimed invention is to provide an arch casing bead which includes a plurality of notches which include an arcuate portion to prevent angular deformation of the arch casing bead when forming an arch.

Briefly, and in accordance with the foregoing, the present invention envisions an arch casing bead having a mounting flange and a ground flange extending therefrom. The mounting flange includes a free edge and an edge proximate to a junction of the ground flange and the mounting flange. A notch is formed in the mounting flange extending from the free edge towards the ground flange. The notch defines an arcuate portion which is positioned proximate to the ground flange. A pair of spaced apart edges extend from the arcuate portion to the free edge defining a mouth of the notch. The notch facilitates arcuate deformation of the elongated casing bead without angularly deforming the ground flange.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which.

DESCRIPTION

Figure 1:
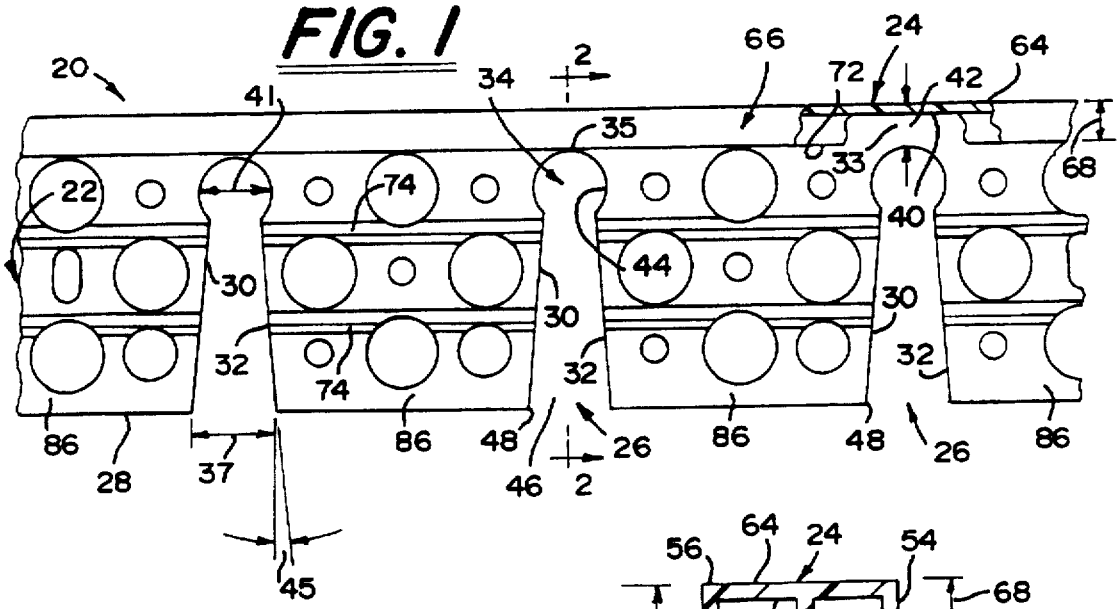
FIG. 1 is a partial fragmentary, partial cross-sectional, top plan view of a portion of a novel arch casing bead of the present invention.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

Figure 4:
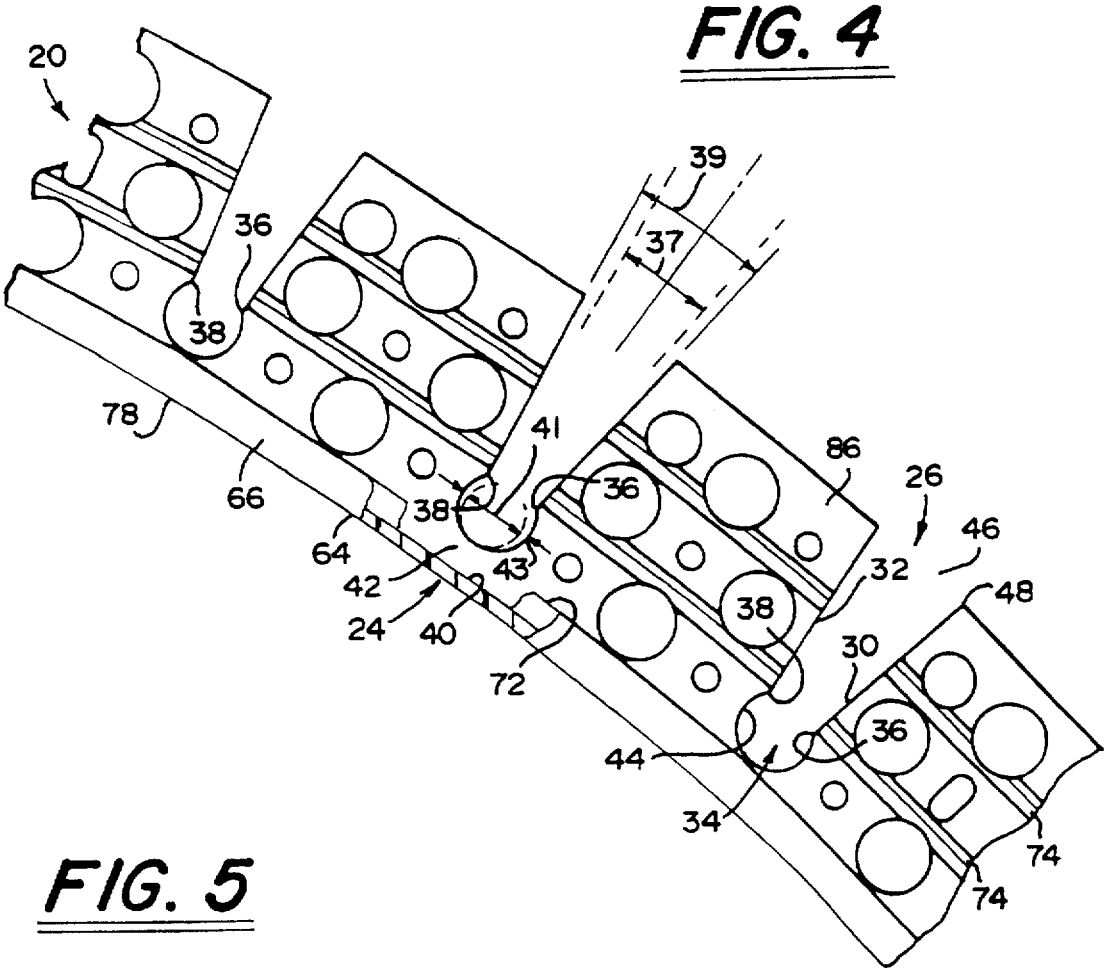
FIG. 4 is a partial fragmentary, top plan view of the novel arch casing bead of the present invention as shown in FIG. 1 which has been bent to form an arcuate casing edge.
Figure 5:
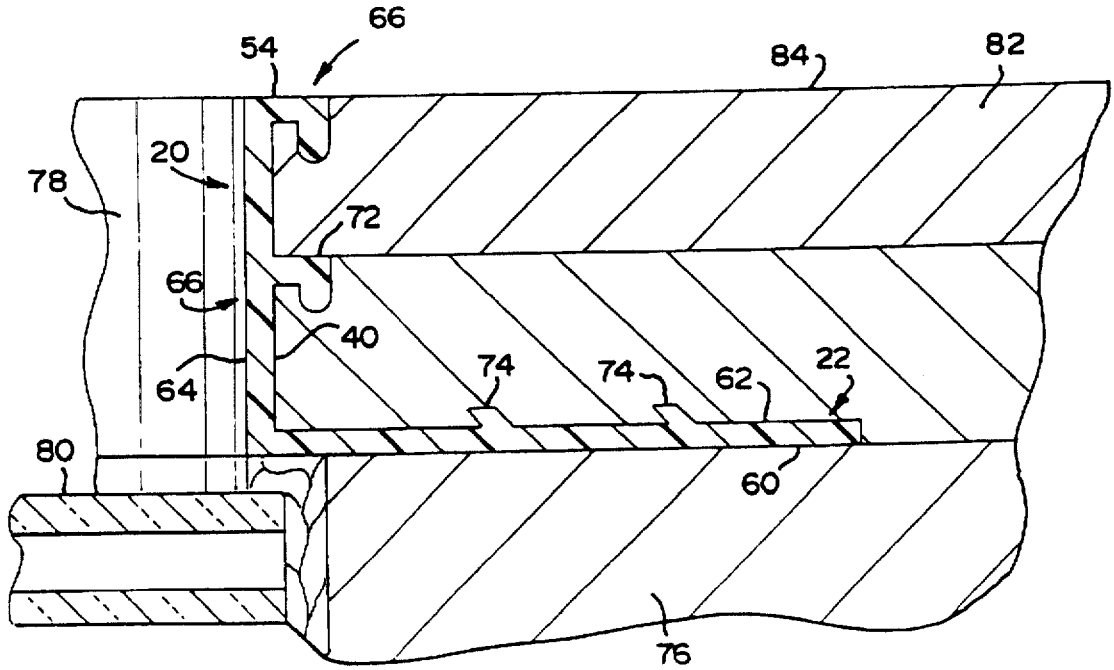
FIG. 5 is an enlarged, cross-sectional, side elevational view taken along line 5—5 in FIG. 3.
Figure 6:
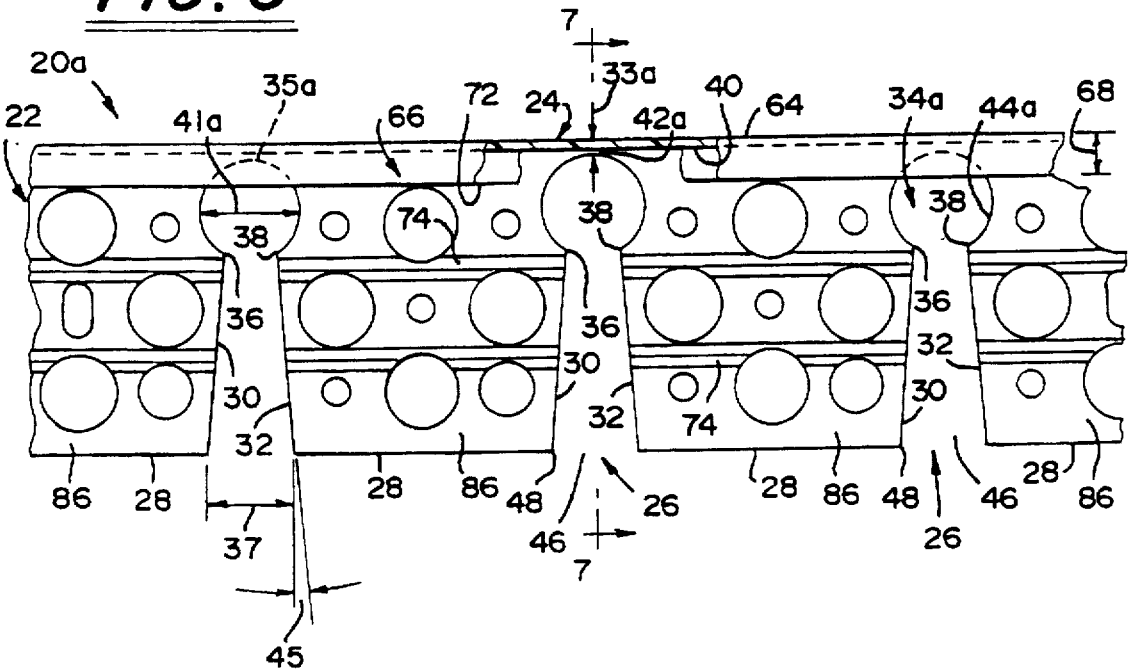
FIG. 6 is a partial fragmentary, partial cross-sectional, top plan view of a second embodiment of the novel arch casing bead of the present invention.
Figure 7:
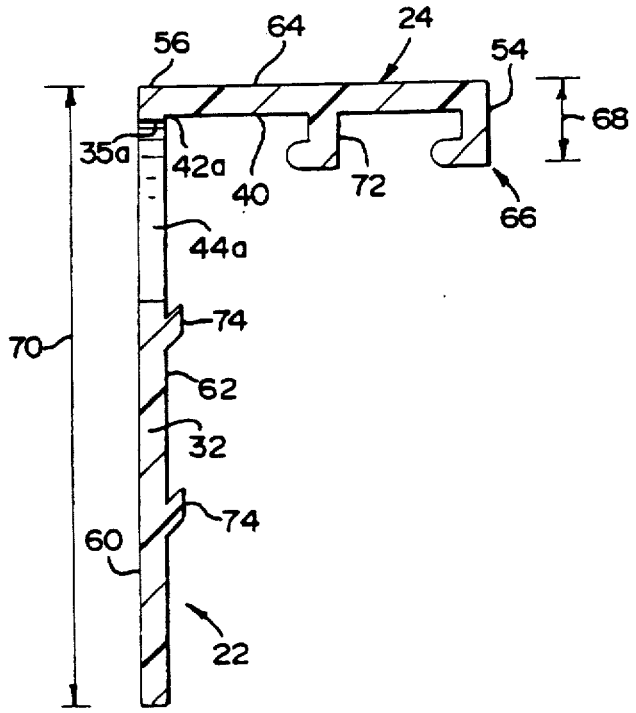
FIG. 7 is an enlarged, cross-sectional, side elevational view of the second embodiment of the novel arch casing bead as shown in FIG. 6.

FIGS. 1–7 illustrate two embodiments of the present invention. FIGS. 1–5 show a first embodiment with FIGS. 6 and 7 showing a second embodiment. Throughout this description and in the claims, reference may be made to plastering or stucco construction. Applicant intends that the definition of plastering or stucco be broadly interpreted to include plastering techniques and stuccoing techniques as well as plastering or stuccoing over a rigid surface such as dry wall or foam board. Generally, the present invention is not limited to the type of material used in the plastering or stucco construction and will be of great advantage to any form of similar construction technique. Throughout the remainder of this description, Applicant will refer to plaster in the interest of brevity and clarity.

Figure 2:
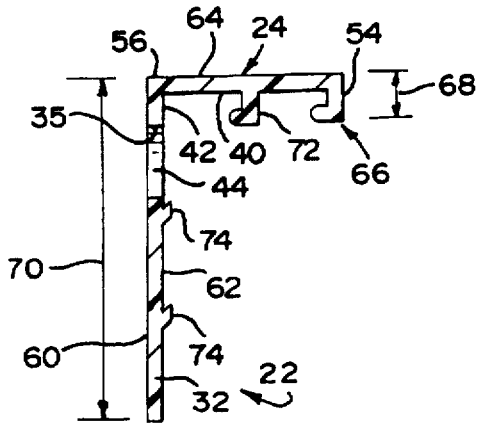
FIG. 2 is a cross-sectional view of the novel arch casing bead of the present invention taken along 2—2 in FIG. 1.

FIG. 1 shows a top plan view of a novel casing bead 20 which may be used to form arch or arcuate features in plaster construction. With further reference to FIG. 2, the casing bead 20 includes a mounting flange 22, a ground flange 24, the mounting flange 22 has a series of notches 26 therein. The mounting flange 22 and ground flange 24, as well as other components to be described hereinbelow, extend generally parallel to a common axis of elongation. The mounting flange 22 has a free edge 28 spaced away from the ground flange 24. Each notch 26 includes a pair of elongated edges 30, 32 which extend from the free edge towards the ground flange 24. An arcuate portion 34 of the notch 26 is positioned between an adjoining edge 36, 38 of each of the elongated edges 30, 32, respectively. The notches 26 are preferably preformed to eliminate the need for the tradesperson to form such notches 26 in the field. However, it is envisioned that a manual die cutter may be provided to the tradesperson for cutting notches 26, in accordance with the teaching of this invention, in the field.

The notches 26 are spaced along the mounting flange 22 with the arcuate portions 34 positioned in relatively close proximity to the ground flange 24 to promote flexing of the casing bead 20 and preventing kinking, crimping or arcuate bending of the ground flange 24. The arcuate shape of the arcuate portion 34 helps prevent cracking of the mounting flange 22 and ground flange 24. While prior art corner bead constructions show angular terminal points and preformed notches, the present invention eliminates angular edges or notch terminus to prevent failure of the mounting flange 22 and ground flange 24 materials as a result of crack propagation produced by the angular notch.

In FIGS. 6 and 7 a second embodiment of the novel casing bead 20*a* of the present invention is shown in which arcuate portion 34*a* extends to a position in close proximity to an internal surface 40 of the ground flange 24. In FIG. 1 a joining web 42, having a width dimension 33, extends between an arcuate edge 44 of the arcuate portion 34 and an internal surface 40 of the ground flange 24. In contrast, in FIG. 6 the joining web 42*a* has a much smaller width 33*a* than as shown in FIG. 1. As such, in FIG. 1*a* tangential portion 35 of the arcuate portion 34 is positioned spaced away from the internal surface 40 of the ground flange 24. In contrast, in FIG. 6 a tangential portion 35*a* of the arcuate portion 34*a* is in close proximity to the internal surface 40 of the ground flange 24. The smaller web 42*a* as shown in FIG. 6 reduces the material between the arcuate edge 44 and the internal surface 40 of the ground flange thereby reducing the material which might be fractured. By reducing the material the chances of crack propagation or failure of the material in the joining web 42*a* and the ground flange 24 are minimized.

With further reference to FIG. 4, both embodiments of the casing bead 20 of the present invention can be curved to form an arc. In the relaxed condition as shown in FIGS. 1 and 6, the notch 26 has a width dimension 37. This "relaxed" width dimension 37 is also shown in FIG. 4. When the casing bead 20 is flexed to form an inside curve, the width of the notch is increased as indicated by width dimension 39 in FIG. 4. Similarly, the arcuate portion 34 has diameter 41, 41*a* (as shown in FIG. 6) which is slightly increased (as indicated by dimension 43 in FIG. 4). As such, even when the casing bead 20 is flexed to form an inside curve as indicated by the change in the dimensions of the notch 26, the casing bead 20 resists cracking along the ground flange 24.

It should be noted that while an inside curve is shown and described in FIG. 4, the casing bead 20 of the present invention may also be used to form an outside curve. In this manner, the casing bead 20 is flexed oppositely to that as shown in FIG. 4. When forming an outside curve, the opposed edges 30, 32 are brought closer together and the diameter 41, 41*a* may decrease in size. As shown in the figures, the elongated edges 30, 32 taper outwardly relative to the arcuate portion 34. The outwardly tapered edges 30, 32 allow the edges to be brought together without overlapping thereby promoting the formation of outside curves. The extent to which the outside curve can be formed can be controlled by the angle of taper of the edges 30, 32. In this regard, the edges can be flexed to the point where portions of the edges may be in abutment but not overlapping.

Having now briefly described the overall aspects of the present invention, further aspects are provided hereinbelow. The foregoing description is not intended to suggest prominence of these aspects but rather has been provided as an overview to facilitate understanding of the present invention.

With further reference to FIGS. 1 and 4, the elongated spaced apart edges 30, 32 define a notch gap 46 therebetween. As shown, the edges 30, 32 taper outwardly at the angle of taper 45 from the corresponding adjoining end edges 36, 38 towards the corresponding free edges 28. The notch gap 46 defines a notch mouth 48 at the free edge 28 of the mounting flange 22. The diameter 41 of the arcuate portion 34 in the relaxed, unflexed condition (shown in FIGS. 1 and 6) is approximately equal to the width dimension 37 of the notch mouth 48.

As further shown in the cross-sectional views of FIGS. 2 and 7, the ground flange 24 has a first edge or top edge 54 and a second edge 56 opposite said first edge 54. The mounting flange 22 is attached to the ground flange 24 at the second edge 56. As such, the ground flange 24 extends away from the mounting flange 22 and similarly the mounting flange 22 extends away from the ground flange 24. The mounting flange also has an abutting surface 60 and a material surface 62. Similarly, the ground flange 24 has the internal surface 40 and an external surface 64. The internal surface 40 is juxtaposed the material surface 62. While the ground flange 24 and the mounting flange 22 are generally perpendicular, it is envisioned that other angles may be desirable and provided while still generally achieving the desired results provided by the present invention.

As also shown in the figures, the casing bead 20 includes a return flange 66 which extends from the top edge 54 of the ground flange 24. The return flange 66 generally extends away from the internal surface 40 and generally parallel to the mounting flange 22. The return flange 66 provides an additional finishing and screed surface for achieving a generally uniform finished plaster surface and edge. As can be seen in the figures, the return flange 66 has a flange width 68 which is substantially smaller than the width 70 of the mounting flange 22. A reinforcer or rib 72 is formed on the internal surface 40 of the ground flange 24. The rib 72 provides additional strengthening of the ground flange 24 and resists kinking, crimping, and arcuate deformation of the ground flange. While the rib 72 must also be flexed when forming an arch structure using the casing bead 20 of the present invention, the rib 72 helps to resist crimping or angular deformation of the ground flange 24. Additionally, plaster engaging protrusions 74 are provided on the material surface 62 of the mounting flange 22 to provide better engagement between plaster applied against the material surface 62 and the casing bead 20.

With reference to FIG. 5, a portion of casing bead 20 is shown in cross-section attached to an underlying structure 76 to form an arcuate casing edge 78. FIG. 5 is a cross-sectional view taken along line 5—5 of FIG. 3 which shows an elevational view of the arch casing bead 20 of the present invention employed around a window 80. As shown in FIG. 5, the casing bead 20 is attached to the structure 76 with the abutting surface 60 lying against the structure 76. Plaster 82 is applied to the structure 76 and the casing bead 20. As discussed above, the return flange 66 provides a screed edge to facilitate forming a uniform finished surface 84. The rib 72 and the return flange 66 also engage the plaster to retain the ground flange 24 in a desired position in a similar manner to the protrusions 74. When the plaster 82 has dried, the finished surface 84 and the arcuate casing edge surface 78 can be finished or painted. The arcuate casing edge 78 eliminates the need to plaster an arcuate edge as would be necessary if corner beading was used for forming such arch structures. Plastering is not required to remove or correct angular deformation with the novel casing bead 20 of the present invention because the ground flange 24 forms a smooth arcuate surface.

The present invention is also defined in terms of a plurality of tabs 86 which extend from the ground flange 24. Neighboring tabs 86 have elongated edges 30, 32 and the arcuate edge 44 defining the notch 26 therebetween. In the embodiment as shown in FIG. 1, the joining web 42 extends between each pair of neighboring tabs 86. In the embodiment as shown in FIG. 6, the joining web **42*a* is almost nonexistent as it is a very small piece of material. The small web 42*a* as shown in FIG. 6 may be produced as long as the ground flange is not nicked, cut, or in any other way weakened in the manufacturing process. Such weakening would promote crimping of the ground flange. As such, the web 42*a* is not required as long as manufacturing processes and tolerances can be maintained to place the tangential portion 35*a* of the arcuate edge 44*a* as close to the internal surface 40 without weakening the material of the ground flange 24**.

Figure 3:
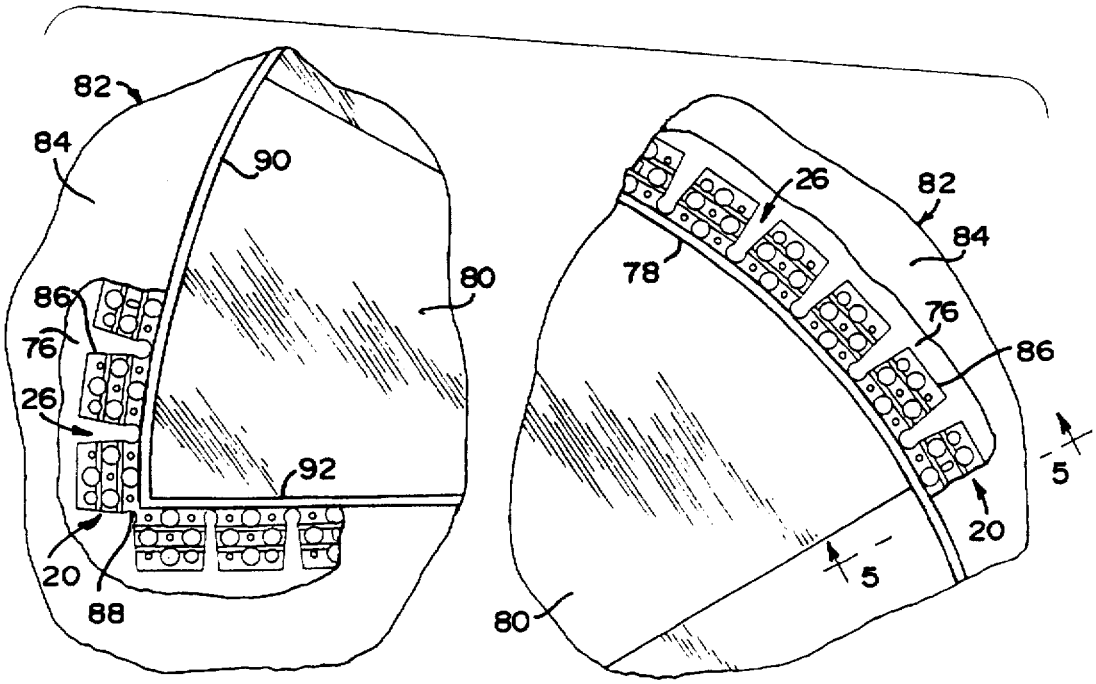
FIG. 3 is a partial fragmentary, partially revealed view of portions of the novel arch casing bead of the present invention employed in a casing edge around a portion of a window.

In use, the casing bead 20 of the present invention may be attached to form an arcuate casing edge 78. Additionally, as shown in FIG. 3, the casing bead 20 can be cut and positioned at a miter joint 88 to provide angular termination of an arch 90 against a generally linear section 92. The tab portions 86 forming the mounting flange 22 are attached to the underlying structure 76, using nails, staples, adhesive (not shown) or any other attachment technique. The casing bead 20 is then curved to form the desired arch 90. Plaster material is applied to the structure 76 and the casing bead 20 to provide a final plastered surface. The casing bead 20 of the present invention provides a smooth continuous arcuate casing edge 78 which does not have angular deformation or crimps as may occur when using prior art casing bead structure in this application.

While a preferred embodiment of the present invention is shown and described, it is envisioned that those skilled in the art may devise various modifications and equivalents without departing from the spirit and scope of the invention as defined by the appended claims. The invention is not intended to be limited by the foregoing disclosure.

The invention claimed is:

1. A casing bead article for use in plaster construction, said casing bead being a generally elongated strip of material, said casing bead article comprising:

a mounting flange having an abutting surface for contacting an underlying structure and a material surface for receiving a plaster construction material thereagainst;

a ground flange attached to and extending away from said mounting flange, said ground flange having an internal surface juxtaposed to said material surface and an external surface opposite said internal surface;

a free edge of said mounting flange spaced from said ground flange; and said mounting flange having a series of notches extending from said free edge towards said ground flange, each of said notches having a pair of elongated edges extending from said free edge towards said ground flange, and an arcuate portion of said notch being positioned between said elongated edges and said ground flange, said arcuate portion defining an arcuate edge connecting said pair of elongated edges;

said elongated edges are spaced apart defining a notch gap therebetween; and said elongated edges being disposed at an angle relative to one another and tapering outwardly from said arcuate portion to said free edge of said mounting flange.

2. A casing bead article as recited in claim 1, wherein said arcuate portion of said notch is spaced from said internal surface of said ground flange.

3. A casing bead article as recited in claim 1, wherein a tangential portion of said arcuate portion is in close proximity to said internal surface of said ground flange.

4. A casing bead article as recited in claim 1, said ground flange having a top edge distal said mounting flange, said casing bead article further comprising:

a return flange extending from said top edge of said ground flange generally noncoincident with said ground flange, said return flange having a width dimension which is less than a width dimension of said mounting flange.

5. A casing bead article as recited in claim 4, further comprising:

at least one rib on said ground flange spaced between said return flange and said mounting flange for resisting crimping of said ground flange.

6. A casing bead article as recited in claim 4, said arcuate edge of said arcuate portion of said notch being spaced from said ground flange a dimension approximately equal to said width dimension of said return flange.

7. A casing bead article as recited in claim 1, further comprising:

at least one elongated rib on said ground flange for resisting crimping of said ground flange.

8. A casing bead article as recited in claim 1, said casing bead article being formed of a plastic material.

9. A casing bead article as recited in claim 8, wherein said casing bead is formed in a plastic extrusion process.

10. An elongated casing bead article comprising:

an elongated ground flange having a first elongated edge and second elongated edge extending generally parallel relative to an exterior surface and an interior surface;

a plurality of neighboring tabs attached to and extending from said second edge of said ground flange;

each of said tabs having a free edge spaced from said second edge of said ground flange, each pair of said plurality of neighboring tabs defining a notch therebetween, each of said notches having a pair of elongated edges extending from said free edge and terminating in an arcuate portion approximate to said second edge of said ground flange; said elongated edges of said notch are disposed at an angle defining a tapered notch gap therebetween, said notch gap tapering outwardly from said arcuate portion to said free edge of said neighboring tabs.

11. An elongated casing bead as recited in claim 10, said elongated casing bead further comprising:

a joining web attached to said second edge of said ground flange and extending between and connecting a pair of said neighboring tabs along said second edge of said ground flange, said joining web spacing said arcuate portion of said notch away from said ground flange.

12. An elongated casing bead as recited in claim 11, further comprising:

a return flange extending from said first edge of said ground flange, and wherein said return flange has a width dimension which is less than a width dimension of said mounting flange.

13. An elongated casing bead as recited in claim 12, said joining web having a minimum width dimension measured from said external surface of said ground flange to a tangential portion of an arcuate edge of said arcuate portion which is approximately equal to a width dimension of said return flange.

14. An elongated casing bead article as recited in claim 10, wherein said arcuate portion is in close proximity to said internal surface of said ground flange.

15. An elongated casing bead article as recited in claim 10, further comprising:

at least one elongated rib on said ground flange for resisting crimping of said ground flange.

16. An elongated casing bead article as recited in claim 10, said casing bead article being formed of a plastic material.

17. An elongated casing bead article as recited in claim 10, wherein said casing bead formed of a plastic material is formed in a plastic extrusion process.

18. A casing bead article for use in forming an arch construction in a plaster or stucco construction, said casing bead comprising:

an elongated ground flange having an internal surface and an external surface;

a mounting flange attached to said ground flange and extending away from said internal surface of said ground flange, said mounting flange having a free edge spaced from said ground flange;

said mounting flange having a plurality of notches therein extending from said free edge towards said ground flange, each of said notches having a pair of elongated edges extending from said free edge towards said internal surface of said ground flange defining a notch gap therebetween and an arcuate portion having an arcuate edge extending between and connecting said elongated edges, said elongated edges tapering outwardly from said arcuate portion towards said free edge of said mounting flange.

19. A casing bead as recited in claim 18, wherein said elongated edges define a notch mouth along said free edge of said mounting flange, and wherein a diameter of said arcuate portion is approximately equal to a width dimension of said notch mouth.

* * * * *